US009259608B2

(12) United States Patent
Beck et al.

(10) Patent No.: US 9,259,608 B2
(45) **Date of Patent: *Feb. 16, 2016**

(54) MUSCLE STRETCHING AND MASSAGING APPARATUS

(71) Applicant: Dynamic Sports Products, LLC, Vestavia Hills, AL (US)

(72) Inventors: Lemuel Joshua Beck, Birmingham, AL (US); Tanya Joan Beck, Birmingham, AL (US)

(73) Assignee: Dynamic Sports Products, LLC, Vestavia Hills, AL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/451,206

(22) Filed: Aug. 4, 2014

(65) Prior Publication Data

US 2014/0342886 A1 Nov. 20, 2014

Related U.S. Application Data

(63) Continuation of application No. 13/565,633, filed on Aug. 2, 2012, now Pat. No. 8,801,579.

(60) Provisional application No. 61/574,431, filed on Aug. 2, 2011.

(51) Int. Cl.
*A63B 21/00* (2006.01)
*A63B 23/04* (2006.01)

(52) U.S. Cl.
CPC ..... *A63B 21/1465* (2013.01); *A63B 23/04* (2013.01); *A63B 2208/0204* (2013.01); *A63B 2208/0247* (2013.01); *A63B 2208/0252* (2013.01); *A63B 2225/093* (2013.01)

(58) Field of Classification Search
CPC ..... A63B 21/00
USPC ..... 482/41, 39, 142, 120, 38, 91, 907, 31
See application file for complete search history.

(56) References Cited

U.S. PATENT DOCUMENTS

| | | | | |
|---|---|---|---|---|
| 2,638,089 | A | 5/1953 | Murphy | |
| 4,660,548 | A | 4/1987 | Bucher | |
| 4,696,470 | A | 9/1987 | Fenner | |
| 4,832,006 | A | 5/1989 | Kirsch | |
| 5,277,676 | A | 1/1994 | Holland | |
| D347,869 | S | 6/1994 | Friend | |
| 5,405,306 | A | 4/1995 | Goldsmith | |
| 5,538,487 | A | 7/1996 | Fulmer | |
| 6,244,992 | B1 | 6/2001 | James | |
| 6,699,162 | B2 * | 3/2004 | Chen | 482/140 |
| 6,743,152 | B2 | 6/2004 | Weiss | |

(Continued)

*Primary Examiner* — Jerome W Donnelly
(74) *Attorney, Agent, or Firm* — Paul Sykes; Bradley Arant Boult Cummings LLP

(57) ABSTRACT

A muscle stretching and massaging apparatus enables stretching of the calf at varying levels of intensity and massaging of muscles of the leg while those muscles are in a relaxed state. A support frame provides a stable base for the apparatus and means for receiving and supporting a lateral roller at a plurality of heights and a stretch board at a plurality of angles relative to a supporting surface. The stretch board enables calf stretching at varying levels of intensity, depending on the severity of the angle formed between the stretch board and the surface upon which the support frame rests. The adjustable height of the roller further enables the apparatus to provide calf and hamstring massaging while the muscles are in a relaxed state.

19 Claims, 4 Drawing Sheets

(56) References Cited

U.S. PATENT DOCUMENTS

| | | | |
|---|---|---|---|
| 7,169,098 | B1 | 1/2007 | McGanty |
| 7,575,560 | B2 | 8/2009 | Mizuuchi |
| D613,804 | S | 4/2010 | Perez |
| 2008/0051682 | A1 | 2/2008 | Thomas |
| 2008/0146972 | A1 | 6/2008 | Thomas |
| 2009/0062699 | A1 | 3/2009 | Yang |
| 2010/0063429 | A1 | 3/2010 | McClorey |
| 2010/0241037 | A1 | 9/2010 | Thomas |

* cited by examiner

MUSCLE STRETCHING AND MASSAGING APPARATUS

REFERENCE TO RELATED APPLICATIONS

This application is a continuation of U.S. patent application Ser. No. 13/565,633 filed on Aug. 2, 2012 which claims the benefit of and priority to U.S. Provisional Patent Application No. 61/574,431 entitled "CalfMatic-calf massager and calf stretcher" and filed on Aug. 2, 2011.

BACKGROUND

Serious athletes recognize the importance of stretching and massaging the muscles that are crucial to peak performance. When athletes train hard, by-product adhesions develop in the muscle and inhibit maximum muscle performance. By incorporating stretching and massaging routines into their daily workout regimen, athletes can break up those by-product adhesions and encourage the ridding of lactic acid, which enables peak performance. Stretching also provides many additional benefits, including increased flexibility and joint range of motion, improved circulation of blood to the muscles, improved posture, stress relief, and enhanced coordination.

The calves and hamstrings constitute core groups of leg muscles that are essential to almost every physical activity. For this reason, it is important to incorporate proper routines for the stretching and massaging of these muscles into any workout regimen. The broad purpose of the present disclosure is to provide a single apparatus that enables one to stretch the calf muscles at varying degrees of intensity and to massage the calves and hamstrings while they are in a relaxed state.

SUMMARY

A muscle stretching and massaging apparatus according to an embodiment of the present disclosure enables its user to stretch the calf muscles at varying levels of intensity and to massage muscles of the leg, including particularly the calves and hamstrings, while those muscles are in a relaxed state. A support frame provides a stable base for the apparatus and means for receiving and supporting a lateral roller at a plurality of heights and a stretch board at a plurality of angles relative to a supporting surface. The support frame comprises a pair of opposing side plates rigidly affixed to one another with a plurality of lateral members. The opposing side plates are substantially identical, and each comprises a lower portion and an upper portion. The lower portions of the opposing side plates each have a wider base and narrower top. The upper portions of the opposing side plates extend vertically from the tops of the lower portions.

The front edges of the lower portions of the opposing side plates contain a means for adjustably affixing a stretch board to the support frame at a plurality of locations, such that the stretch board may be positioned at a plurality of angles relative to the surface upon which the support frame rests. In one embodiment of the present invention, the means for receiving and supporting the stretch board comprises a plurality of lower slot pairs in the front edges of the lower portions of the opposing side plates. In this embodiment, the stretch board has a rod, protrusion, stop, or any similar mechanical means approximate with and affixed to the outer sides of its upper edge to engage one of the plurality of lower slot pairs. The lower edge of the stretch board rests on the surface. The angle between the stretch board and the surface may be adjusted by moving the stretch board from one lower slot pair to another.

This configuration enables an athlete to stand on the upper surface of the stretch board and stretch his or her calf muscles at varying levels of intensity, depending on the angle formed between the stretch board and the surface.

The front edges of the upper portions of the opposing side plates contain a means for adjustably affixing a lateral roller to the support frame at a plurality of heights, such that the lateral roller may be positioned at a plurality of heights relative to the support frame, to suit the needs of a particular athlete or exercise. In one embodiment of the present invention, the means for receiving and supporting the lateral roller comprises a plurality of upper slot pairs in the front edges of the upper portions of the opposing side plates. In this same embodiment, the lateral roller has protrusions on its left and right ends to engage one of the plurality of upper slot pairs, thereby affixing it to the support frame. The height of the lateral roller relative to the support frame may be adjusted by moving the lateral roller from one upper slot pair to another. This configuration enables a user to lie on his or her back, position one of his or her legs on the lateral roller, and massage his or her calf muscle while it is in a relaxed state by moving his or her leg back and forth across the lateral roller. This configuration also enables a user, from a standing position, to drape one of his or her legs over the lateral roller and massage his or her hamstrings while they are in a relaxed state by moving his or her leg back and forth across the lateral roller. In one embodiment, the height of the upper portion accommodates a calf massage; in another embodiment, the height of the upper portion is increased such that it is suited for the calf massage as well as the hamstring massage for athletes of nearly any size.

It is an advantage of the present disclosure that the apparatus allows a user to adjust the angle of the stretch board to provide multiple levels of intensity for the stretching of the user's calf muscles. It is a further advantage of the present disclosure that the apparatus also allows a user to adjust the lateral roller to multiple heights to enable the user to massage his or her leg muscles in a relaxed state.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein.

These and other embodiments of the present invention will also become readily apparent to those skilled in the art from the following detailed description of the embodiments having reference to the attached figures, the invention not being limited to any particular embodiment(s) disclosed.

Figure 2:
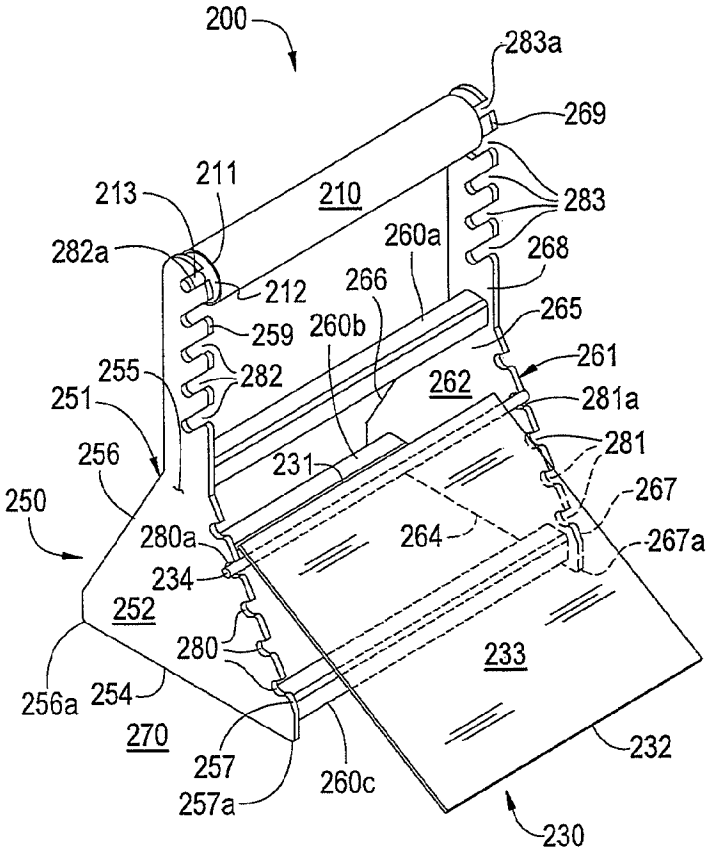
FIG. 2 is a perspective view of an apparatus according to an alternative embodiment of the present disclosure.

Repeat use of reference characters throughout the present specification and appended drawings is intended to represent the same or analogous features or elements of the invention.

DETAILED DESCRIPTION

Referring to FIGS. 1, 3-5, an exemplary embodiment of a muscle stretching and massaging apparatus 100 comprises a lateral roller 110, a stretch board 130, and a support frame 150. The support frame 150 stabilizes the apparatus 100 when in use and provides a means for receiving and supporting the lateral roller 110 at a plurality of heights and the stretch board 130 at a plurality of angles relative to a lateral surface 170 upon which the support frame 150 rests.

The support frame 150 comprises a pair of opposing side plates—a left side plate 151 and a right side plate 161—and a plurality of cross members 160*a*, 160*b*, 160*c* affixed to the opposing side plates 151, 161. The support frame 150 may be fabricated from any suitably strong and rigid material, such as aluminum, stainless steel, any other ferrous or non-ferrous metal, composites (such as carbon fiber or graphite), plastics, or wood.

The opposing side plates 151, 161 are substantially identical and comprise lower portions 152, 162 and upper portions 153, 163. The lower portions 152, 162 have wider bases 154, 164 and narrower tops 155, 165, which adds stability and provides slanted front edges 157,167 described below. In the embodiment illustrated in FIGS. 1, 3-5, the lower portions 152, 162 of the opposing side plates 151, 161 are comprised of a single piece of material of uniform thickness (½") that is substantially triangular in shape. Other shapes and dimensions for the opposing side plates are provided in other embodiments, and these shapes and dimensions should be considered illustrative. Other shapes and dimensions could be used for particular purposes. In a preferred embodiment, each side plate 151, 161 may comprise feet that are adjustable in height (such as by a threaded insertion) to allow a user to level the support frame 150 when used on uneven or slanted surfaces.

The lower portions 152, 162 of the opposing side plates 151, 161 further comprise rear edges 156, 166 and front edges 157, 167. In the embodiment illustrated in FIGS. 1, 3-5, the rear edges 156, 166 and the front edges 157, 167 are convex and curve outward as they progress from the wider bases 154, 164 to the narrower tops 155, 165. The front edges 157, 167 comprise a means for adjustably affixing the stretch board 130 to the support frame 150 at a plurality of locations, such that the stretch board 130 may be positioned at a plurality of angles relative to the surface 170 upon which the support frame 150 rests. In the embodiment illustrated in FIGS. 1, 3-5, the means for receiving and supporting the stretch board 130 comprises a plurality of lower slots 180, 181 in the front edges 157, 167 of the lower portions 152, 162 of the opposing side plates 151, 161. The lower slots 180, 181 are preferably angled upwardly to allow the lower portions 152, 162 of the opposing side plates 151, 161 to securely receive and support the stretch board 130. In the embodiment illustrated in FIGS. 1, 3-5, the front edges 157, 167 of the lower portions 152, 162 of the opposing side plates 151, 161 each contain four (4) slots. Other embodiments may contain alternative numbers of slots, as well as alternative means for adjustably affixing the stretch board 130 to the support frame 150 as would be understood to one of ordinary skill in the art. For example, rather than a plurality of lower slots in the front edges 157, 167 of the lower portions 152, 162 of the opposing side plates 151, 161, the lower portions 152, 162 may comprise an elongate slot, inward from but adjacent to the front edges 157, 167, extending from near the base of the lower portions 152, 162 up towards the narrower tops 155, 165, with paired notches along the lower edge of the elongate slot to receive and position the stretch board 130 similar to that as described above.

In the embodiment shown, the front edge 157 of the lower portion 152 of the left side plate 151 contains the same number of lower slots 180 as the front edge 167 of the lower portion 162 of the right side plate 161, such that the lower slots 180, 181 form a plurality of lower slot pairs to provide multiple settings in which the stretch board 130 may be adjustably affixed to the support frame 150.

The stretch board 130 is preferably rectangular and of uniform thickness. The stretch board 130 comprises an upper edge 131 for engaging the support frame 150 and a lower edge 132 that rests on the surface 170 that is typically horizontal. The stretch board 130 further comprises a rod 134 or similar mechanism affixed to and approximate its upper edge 131 to engage one of the plurality of lower slot pairs to allow the stretch board 130 to be adjustably affixed to the support frame 150. In the embodiment illustrated in FIGS. 1, 3-5, the stretch board is adjustably affixed to one 180*a*, 181*a* of the plurality of lower slot pairs. The rod 134 has a length greater than the width of the stretch board 130 sufficient to allow it to rest in one of the plurality of lower slot pairs. Other embodiments may contain alternative means for adjustably affixing the stretch board 130 to the support frame 150, including protrusions, stops, or any similar mechanical means affixed to the upper edge 131 of the stretch board 130.

Each lower slot within a lower slot pair is positioned at substantially the same height relative to the surface 170, such that the upper edge 131 and the lower edge 132 of the stretch board 130 are level with and substantially parallel to the surface 170 when the stretch board 130 is adjustably affixed to the support frame 150. The stretch board 130 may be fabricated from any suitably strong and rigid material, such as aluminum, stainless steel, any other ferrous or non-ferrous metal, composites (such as carbon fiber or graphite), plastics, or wood.

A user (not shown) may use the apparatus 100 to stretch his or her calf muscles by standing on an upper surface 133 of the stretch board 130 and placing his or her heels away from the apparatus 100 and his or her toes toward the apparatus 100. The intensity of the stretch may be increased by moving the stretch board 130 to a higher lower slot pair. The intensity of the stretch may be decreased by moving the stretch board 130 to a lower lower slot pair. The stretch board 130 may further comprise a non skid layer (not shown) coupled to the upper surface 133 of the stretch board 130 to increase traction and prevent the user from slipping during stretching. The user of the stretch board 130 is not limited to stretching the calf muscles. The stretch board 130 may be used for other exercises and stretches. For example, a user may stand on the stretch board 130 with his toes pointing away from the device apparatus 100, such that his toes are lower than his heels due to the incline of the stretch board 130. From this position, the user can bend over and touch (or attempt to touch) his toes and obtain a hamstring and lower back stretch different from that which can be achieved on a horizontal surface.

The upper portions 153, 163 of the opposing side plates 151, 161 extend upwards, preferably substantially vertically, from the narrower tops 155, 165 of the lower portions 152, 162 of the opposing side plates 151, 161. In the embodiment illustrated in FIGS. 1, 3-5, the upper portions 153, 163 are a continuation of the lower portions 152, 162, such that the opposing side plates 151, 161 each constitute a single component of uniform thickness (½"). Other shapes and dimensions of opposing side plates are provided in other embodiments. The upper portions 153, 163 comprise front edges 159, 169 that provide a means for adjustably affixing the lateral roller 110 to the front edges 159, 169 at a plurality of locations, such that the lateral roller 110 may be positioned at a plurality of heights. In the embodiment illustrated in FIGS. 1, 3-5, this means for receiving and supporting the lateral roller 110 comprises a plurality of upper slots 182, 183 in the front edges 159, 169 of the upper portions 153, 163 of the opposing side plates 151, 161. The upper slots 182, 183 are preferably angled upwardly to allow the upper portions 153, 163 of the opposing side plates 151, 161 to securely receive and support the lateral roller 110. In the embodiment illustrated in FIGS. 1, 3-5, the front edges 159, 169 each contain twelve (12) slots. Other embodiments may contain alternative numbers of slots, as well as alternative means for adjustably affixing the lateral roller 110 to the support frame 150, such as an elongate slot with notches as described above.

In the embodiment illustrated in FIGS. 1, 3-5, the front edge 159 of the upper portion 153 of the left side plate 151 contains the same number of upper slots 182 as the front edge 169 of the upper portion 163 of the right side plate 161, such that the upper slots 182, 183 form upper slot pairs to provide multiple settings in which the lateral roller 110 may be adjustably affixed to the support frame 150. In this embodiment, the lateral roller is adjustably affixed to one 182*a*, 183*a* of the plurality of upper slot pairs. Each upper slot within an upper slot pair is positioned at substantially the same height relative to the surface 170, to allow the lateral roller 110 to rest level with and substantially parallel to the surface 170 when the lateral roller 110 is adjustably affixed to the support frame 150.

The lateral roller 110 comprises an outer wall 111 rotatably engaged with an inner spindle 112. The outer wall 111 is preferably cylindrical and rotates with respect to the inner spindle 112, for example, utilizing standard bearings. In the embodiment illustrated in FIGS. 1, 3-5, the inner spindle 112 further comprises a left protrusion 113 to engage one of the plurality of upper slots 182 in the front edge 159 of the upper portion 153 of the left side plate 151 and a right protrusion 114 to engage one of the plurality of upper slots 183 in the front edge 169 of the upper portion 163 of the right side plate 161. In an alternative embodiment, the inner spindle 112 may further comprise handles 115 (shown only on FIG. 5) that engage one of the plurality of upper slot pairs and extend through the upper slot pair to the outside of the opposing side plates to a length sufficient to allow the user to grab the handles for support and to use the handles to adjust the height of the lateral roller 110 relative to the support frame 150. The height of the lateral roller 110 relative to the support frame 150 may be increased by moving the lateral roller 110 to a higher upper slot pair. The height of the lateral roller 110 relative to the support frame 150 may be decreased by moving the lateral roller 110 to a lower upper slot pair.

Figure 9:
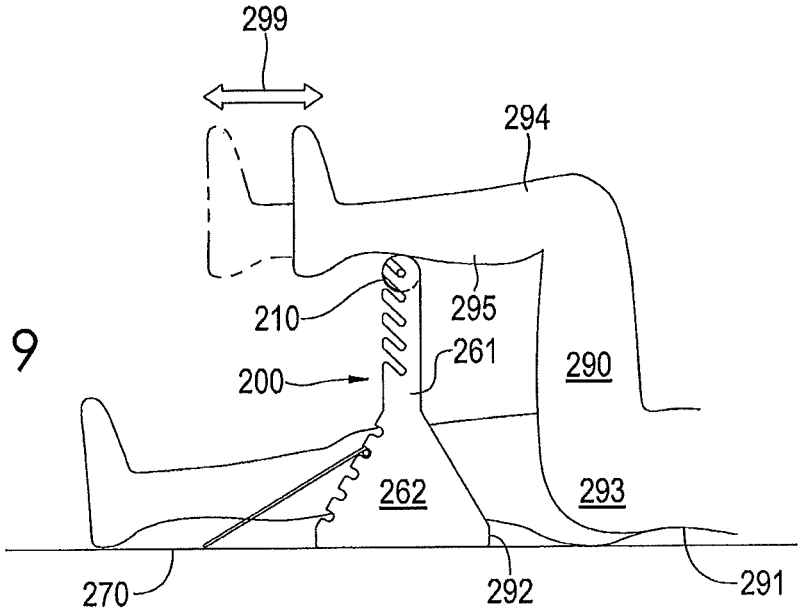
FIG. 9 is a side view of the apparatus of FIG. 2 in use to massage the user's calf muscles.

A user (not shown) may use the apparatus 100 to massage his or her calf muscles by lying on his or her back on the surface 170 at the rear of the apparatus 100 with his or her buttocks near the support frame 150, placing one of his or her legs on the lateral roller 110, and moving his or her leg back and forth across the lateral roller 110. The height of the lateral roller 110 may be adjusted to ensure that the lower portion of the user's leg is substantially parallel to the surface 170 during the massage. This method of massaging allows the user to massage his or her calf muscles while they are in a relaxed state. FIG. 9 depicts this method of massaging the calf muscle in an alternative embodiment of the present disclosure.

Figure 1:
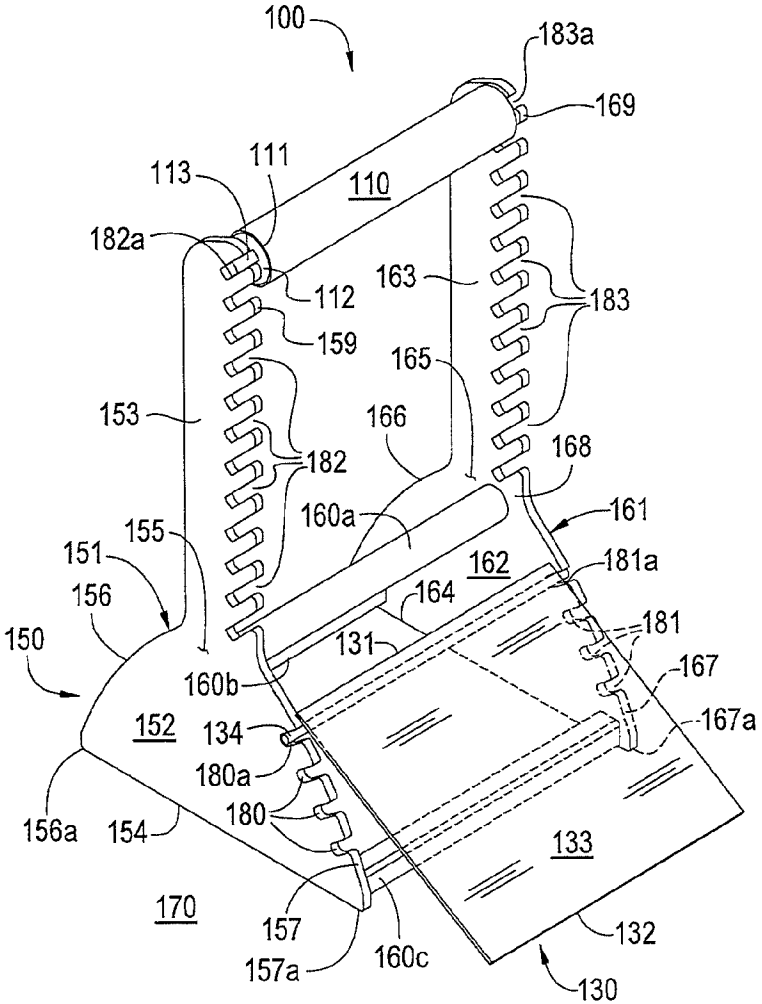
FIG. 1 is a perspective view of an apparatus according to an embodiment of the present disclosure.
Figure 3:
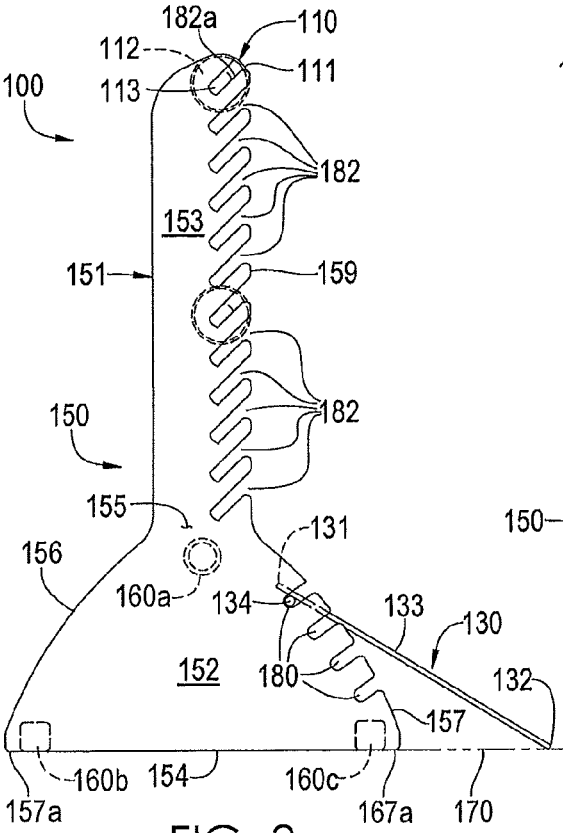
FIG. 3 is side view of the apparatus of FIG. 1.
Figure 4:
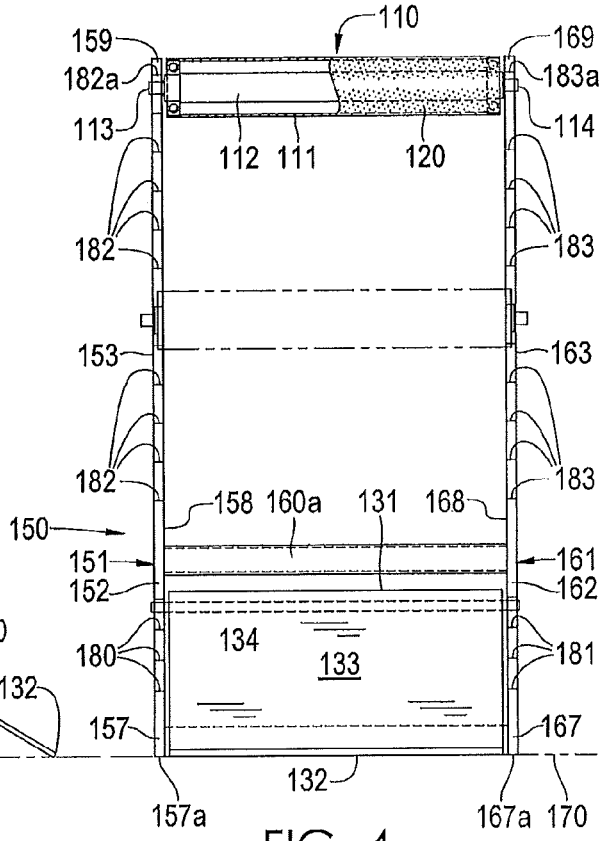
FIG. 4 is a front view of the apparatus of FIG. 1.
Figure 5:
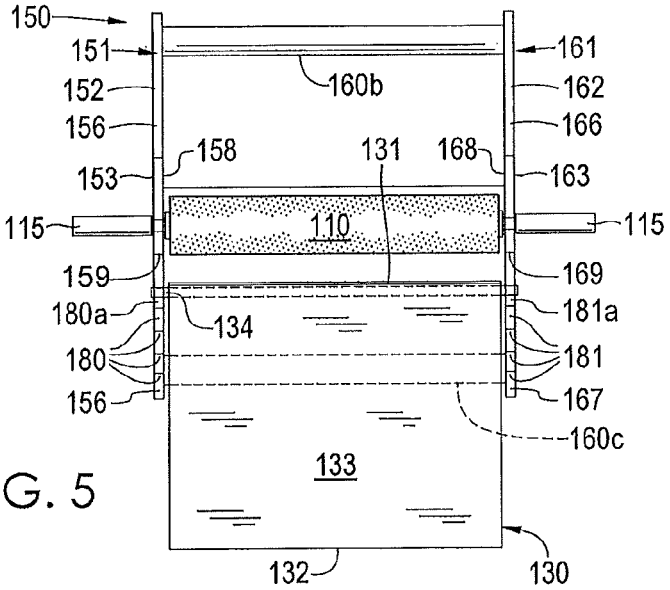
FIG. 5 is a top view of the apparatus of FIG. 1, showing the optional handles on the ends of the lateral roller.
Figure 10:
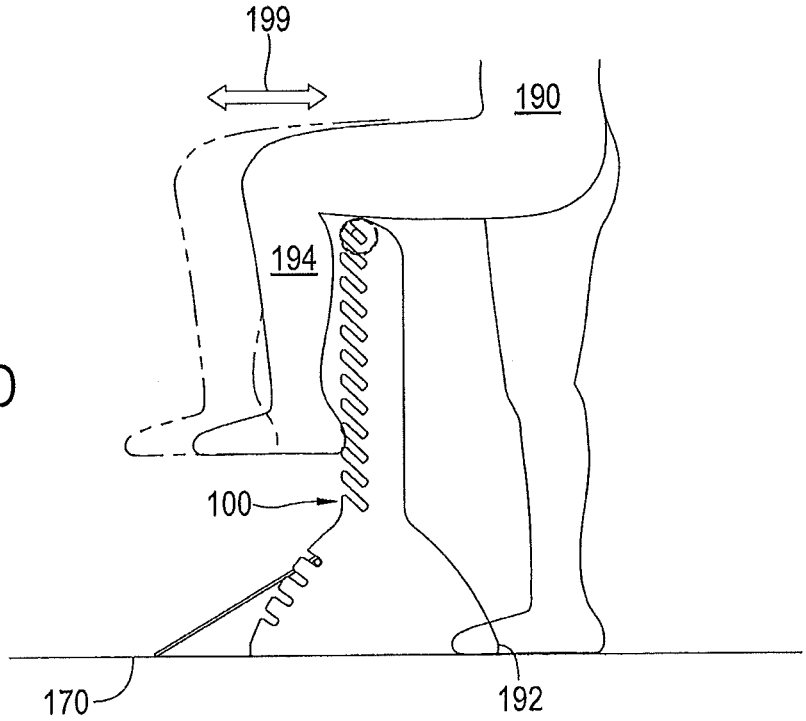
FIG. 10 is a side view of the apparatus of FIG. 1 in use to massage the user's hamstring muscles.

FIG. 10 is a side view of the apparatus 100 of FIG. 1 that demonstrates how a user 190 uses the apparatus 100 to massage his or her hamstrings. A user 190 uses the apparatus 100 to massage his or her hamstrings by standing on the surface 170 at the rear 192 of the apparatus 100 immediately adjacent to the lateral roller 110, draping one of his or her legs 194 over the lateral roller 110, and moving the leg 194 back and forth across the lateral roller 110 as demonstrated by the arrow 199. The lateral roller 110 may be adjusted to a height appropriate to enable the user 190 to comfortably position his or her leg 194 for the massage. This method of massaging allows the user 190 to massage his or her hamstrings while they are in a relaxed state. In addition, a user may grasp the roller 110 by the handles 115 and remove it from the support frame 150, and then massage various muscle groups of the body (including for example the quadriceps) by rolling the roller 110 over the muscle while controlling the movement and pressure applied by using the handles 115.

In the embodiment illustrated in FIGS. 1, 3-5, the apparatus 100 measures about three (3) feet in height from the surface 170 to the top of the opposing side plates 151, 161. This height allows the lateral roller 110 to be adjusted to a height sufficient to allow the vast majority of users to massage their leg muscles. Other embodiments may contain alternative dimensions.

The left side plate 151 and the right side plate 161 are rigidly affixed to one another with a plurality of lateral members. In the embodiment illustrated in FIGS. 1, 3-5, three (3) lateral members 160*a*, 160*b*, 160*c*, shown as horizontal cross bars, span between, and are rigidly affixed to, the left side plate 151 and the right side plate 161. A first horizontal cross bar 160*a* spans between, and is rigidly affixed to, an inner wall 158 of the left side plate 151 and an inner wall 168 of the right side plate 161 at a location proximate to the narrower tops 155, 165 of the lower portions 152, 162 of the opposing side plates 151, 161. In one embodiment, the horizontal cross bar 160*a* may be cylindrical to allow the apparatus 100 to be easily moved from one location to another. A second horizontal cross bar 160*b* spans between, and is rigidly affixed to, the inner wall 158 of the left side plate 151 and the inner wall 168 of the right side plate 161 at a location proximate to the bottoms 156*a*, 166*a* of the rear edges 156, 166 of the lower portions 152, 162 of the opposing side plates 151, 161. A third horizontal cross bar 160*c* spans between, and is rigidly affixed to, the inner wall 158 of the left side plate 151 and the inner wall 168 of the right side plate 161 at a location proximate to the bottoms 157*a*, 167*a* of the front edges 157, 167 of the lower portions 152, 162 of the respective side plates 151, 161.

The plurality of horizontal cross bars 160*a*, 160*b*, 160*c* are substantially uniform in length to maintain the left side plate 151 and the right side plate 161 in substantial parallel. The uniform length of the plurality of horizontal cross bars 160*a*, 160*b*, 160*c* is sufficient to enable both the stretching and massaging functions of the apparatus 100. In the embodiment illustrated in FIGS. 1, 3-5, the horizontal cross bars have a length of eighteen and one-half inches (18½"). Other embodiments may contain alternative dimensions, and other means of laterally connecting and supporting the side plates 151, 161 may be used. For example, a single substantially planar cross member, oriented vertically along the centerline of the side plates 151, 161 may be sufficient for some applications, or such a member in combination with a horizontal plate between the lower portions 152, 162 may be advantageous in other applications. All that is necessary is a lateral member (whether a bar or plate, oriented horizontally or vertically or at some other angle) rigidly connecting the side plates 151, 161 and keeping them in a stable position while the device is in use.

The outer wall 111 of the lateral roller 110 may be fabricated from a material having a low coefficient of thermal conductivity, such as wood, carbon, or plastic. In this way, the lateral roller 110 does not feel cool to the touch and does not act to chill the muscle at the same time one is trying to massage it. In an alternative embodiment, the lateral roller 110 may be fabricated from metal, but may further comprise a sleeve 120, including a removable and replaceable sleeve, made of rubber, neoprene, vinyl, cloth (such as terry cloth), or other material having a low coefficient of thermal conductivity. The sleeve 120 may be washable. This embodiment may be desirable in a gym, locker room, or other environment where a large number of users use the apparatus. In a further alternative embodiment, the sleeve 120 may include one or more chambers (not shown) in which a gel or similar substance is disposed, which may be heated prior to use and placed on the lateral roller 110 to facilitate massage. In yet another alternative embodiment, the lateral roller 110, or a sleeve 120 placed over the lateral roller 110, may comprise a plurality of raised bumps, ridges, fingers, or similar protrusions to further facilitate massage. The plurality of raised bumps, ridges, fingers, or similar protrusions may be rigid, flexible, or semi-flexible, depending on the desired application.

Figure 6:
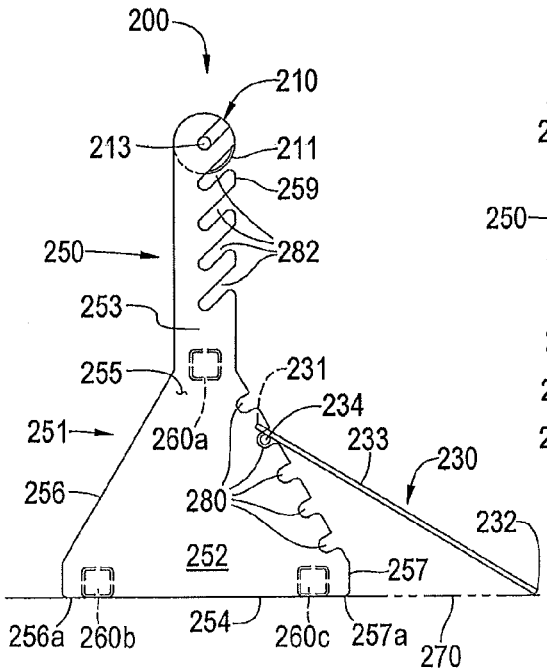
FIG. 6 is a side view of the apparatus of FIG. 2.
Figure 7:
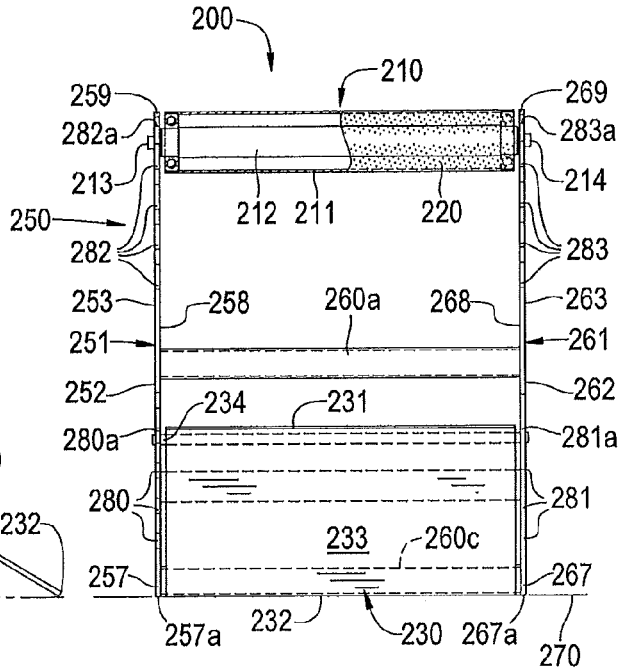
FIG. 7 is a front view of the apparatus of FIG. 2.
Figure 8:
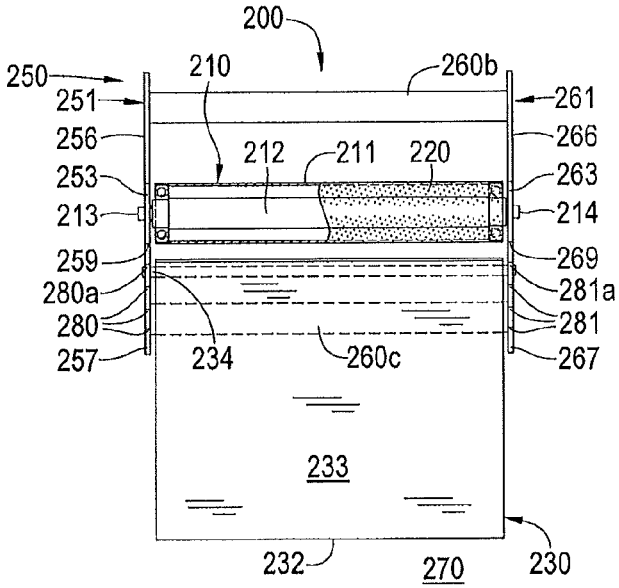
FIG. 8 is a top view of the apparatus of FIG. 2.

FIG. 2 depicts a front/side perspective view of an apparatus 200 according to an alternative embodiment of the present disclosure. FIGS. 6-8 depict alternative views of the apparatus 200 of FIG. 2.

Referring to FIGS. 2, 6-8, the apparatus 200 comprises a lateral roller 210, a stretch board 230, and a support frame 250. The support frame 250 provides a stable base for the apparatus 200. The support frame 250 also provides a means for receiving and supporting the lateral roller 210 at a plurality of heights and the stretch board 230 at a plurality of angles relative to a lateral surface 270 upon which the support frame 250 rests. The embodiment shown in these figures is substantially similar to that shown in FIGS. 1, 3-5, except that the height of upper portions 253, 263 is less than that of the corresponding parts of the embodiment described above. This embodiment is sized such that it is generally suited for massage of the calf muscles, as shown in FIG. 9, and is utilized where the hamstring massage is not necessary or size and space are at a premium. Otherwise, the structures and features of this embodiment are numbered with reference numerals corresponding to their counterparts in the embodiment shown in FIGS. 1, 3-5, above, with the leading '1' replaced with a '2' (e.g., parts 251, 261 in this embodiment correspond to parts 151, 161 in the embodiment described above).

In the embodiment illustrated in FIGS. 2, 6-8, the apparatus measures about two (2) feet in height from the surface 270 to the top of the opposing side plates 251, 261. This height allows the lateral roller 210 to be adjusted to a height sufficient to accommodate the vast majority of users. Other embodiments may contain alternative dimensions.

FIG. 9 depicts a side view of the apparatus 200 of FIG. 2 and demonstrates how a user 290 uses the apparatus 200 to massage his or her calf muscles 295. The user 290 may use the apparatus 200 to massage his or her calf muscles 295 by lying on his or her back 291 on the surface 270 at the rear 292 of the apparatus 200, placing his or her buttocks 293 close to either the lower portion (not shown) of the left side plate (not shown) or the lower portion 262 of the right side plate 261, placing one of his or her legs 294 on the lateral roller 210, and moving the leg 294 back and forth across the lateral roller 210, as demonstrated by the arrow 299. The height of the lateral roller 210 may be adjusted to ensure that the lower portion of the user's leg 294 is substantially parallel to the surface 270 during the massage. This method of massaging allows the user 290 to massage one of his or her calf muscles 295 while the muscle 295 is in a relaxed state. A user may also use the embodiment of FIG. 1 in this manner by lowering the lateral roller 110 to the appropriate height for calf massage.

In either embodiment, a user may position the roller 110, 210 into a lower slot on the lower portion of the side plates and roll the user's foot back and forth over the roller. The massage provided by this motion has been found to be an effective treatment of plantar fasciitis.

Although the description herein discusses a user using the apparatus for stretching the calves and massaging the calves and hamstrings, it is understood that the apparatus described herein could be used for stretching and massaging other muscles without departing from the scope of the present disclosure.

What is claimed is:

1. An apparatus comprising:
- a lateral roller; and
- a support frame, the support frame comprising
  - a pair of opposing side plates connected by at least one lateral member, each said side plate comprising
    - a lower portion and an upper portion, each lower portion comprising a wider base tapering to a narrower top, and each upper portion extending upwardly from the lower portion and comprising a plurality of upper receivers for receiving and supporting the lateral roller at a plurality of heights.

2. The apparatus of claim 1, wherein the height of the opposing side plates enables the roller to be adjusted from a height sufficient to enable a user to massage his or her calf muscles in a relaxed state to a height sufficient to enable the user to massage his or her hamstring muscles in a relaxed state.

3. The apparatus of claim 1, wherein the upper portion extends substantially vertically from the lower portion.

4. The apparatus of claim 2, wherein the roller is fabricated from a material having a low coefficient of thermal conductivity.

5. The apparatus of claim 2, wherein each upper receiver comprises a slot for receiving and supporting the roller.

6. The apparatus of claim 2, wherein the roller comprises an outer wall rotatably engaged with an inner spindle.

7. The apparatus of claim 6, wherein the outer wall is fabricated from a material having a low coefficient of thermal conductivity.

8. The apparatus of claim 6, wherein the outer wall comprises a plurality of raised bumps, ridges, fingers, or similar protrusions.

9. The apparatus of claim 6, wherein the outer wall further comprises a removable sleeve.

10. The apparatus of claim 9, wherein the removable sleeve is fabricated from a material having a low coefficient of thermal conductivity.

11. The apparatus of claim 9, wherein the removable sleeve is washable.

12. The apparatus of claim 9, wherein the removable sleeve comprises one or more chambers in which a gel is disposed to allow the removable sleeve to be heated prior to use.

13. The apparatus of claim 9, wherein the removable sleeve comprises a plurality of raised bumps, ridges, fingers, or similar protrusions.

14. The apparatus of claim 6, wherein the inner spindle comprises a left protrusion and a right protrusion to enable the roller to engage a pair of the plurality of upper receivers, the left and right protrusions extend through the opposing side plates to a length outside of the opposing side plates sufficient to enable the protrusions to serve as handles, said handles allowing a user to adjust the height of the roller.

15. An apparatus comprising:

a lateral roller, a pair of opposing side members connected by at least one lateral member, each said side member comprising a lower portion and an upper portion, the lower portions defining a stable base for said apparatus to allow it to be freestanding on a surface, the upper portions comprising laterally opposed arms projecting upwardly from the lower portions, each said arm having a plurality of upper receivers for receiving and supporting the lateral roller at a plurality of heights, said lateral roller adjustably affixed to the upper portions wherein the height of the roller can be adjusted relative to the surface from a height sufficient to enable a user to massage his or her calf muscles when lying adjacent to said apparatus to a height sufficient to enable the user to massage his or her hamstring muscles when standing adjacent to said apparatus.

16. The apparatus of claim 15, wherein the roller is fabricated from a material having a low coefficient of thermal conductivity.

17. The apparatus of claim 15, wherein said each said receiver comprises a slot into which a distal end of said lateral roller is received.

18. The apparatus of claim 17, wherein the laterally opposed arms of the upper portions extend substantially vertically from the lower portions.

19. The apparatus of claim 15, wherein the laterally opposed arms of the upper portions extend substantially vertically from the lower portions.

* * * * *